US006682643B2

(12) United States Patent
de Nora

(10) Patent No.: US 6,682,643 B2
(45) Date of Patent: Jan. 27, 2004

(54) ALUMINIUM ELECTROWINNING CELLS HAVING A V-SHAPED CATHODE BOTTOM AND METHOD OF PRODUCING ALUMINIUM

(75) Inventor: Vittorio de Nora, Nassau (BS)

(73) Assignee: Moltech Invent S.A. (LU)

( * ) Notice: Subject to any disclaimer, the term of this patent is extended or adjusted under 35 U.S.C. 154(b) by 0 days.

(21) Appl. No.: 09/978,160

(22) Filed: Oct. 16, 2001

(65) Prior Publication Data

US 2002/0088718 A1 Jul. 11, 2002

Related U.S. Application Data

(63) Continuation-in-part of application No. PCT/IB00/00476, filed on Apr. 17, 2000, which is a continuation-in-part of application No. PCT/IB99/00698, filed on Apr. 16, 1999.

(51) Int. Cl.[7] ..... C25C 3/08; C25C 3/06

(52) U.S. Cl. ..... 205/381; 205/372; 205/380; 205/391; 204/245; 204/247; 204/247.3; 204/280

(58) Field of Search ..... 205/372, 380, 205/381, 391; 204/245, 247, 247.3, 280

(56) References Cited

U.S. PATENT DOCUMENTS 5,135,621 A * 8/1992 de Nora et al. ..... 205/385
5,330,631 A * 7/1994 Juric et al. ..... 204/247.3
5,683,559 A * 11/1997 de Nora ..... 204/247.3
6,436,273 B1 * 8/2002 de Nora et al. ..... 205/381
2002/0027069 A1 * 3/2002 de Nora ..... 204/243.1

FOREIGN PATENT DOCUMENTS

WO WO 98/53120 A1 * 11/1998

* cited by examiner

*Primary Examiner*—Nam Nguyen
*Assistant Examiner*—Brian L Mutschler
(74) *Attorney, Agent, or Firm*—Jayadeep R. Deshmukh

(57) ABSTRACT

A cell for the electrowinning of aluminium comprises a plurality of metal-based anodes facing and spaced part from an aluminium-wettable drained cathode surface on which aluminium is produced. The drained cathode surface is formed along the cell by upper surfaces of juxtaposed carbon cathode blocks, the cathode blocks extending across the cell. The drained cathode surface is divided into quadrants by a longitudinal aluminium collection groove along the cell and by a central aluminium collection reservoir across the cell. Pairs of quadrants across the cell are inclined in a V-shape relationship, the collection groove being located along the bottom of the V-shape and arranged to collect molten aluminium draining from the drained cathode surface and evacuate it into the aluminium collection reservoir during cell operation.

26 Claims, 3 Drawing Sheets

ALUMINIUM ELECTROWINNING CELLS HAVING A V-SHAPED CATHODE BOTTOM AND METHOD OF PRODUCING ALUMINIUM

This application is a continuation-in-part of PCT/IB00/00476, filed Apr. 17, 2000, which is a continuation-in-part of PCT/IB99/00698, filed Apr. 16, 1999.

FIELD OF THE INVENTION

This invention relates to a cell for the electrowinning of aluminium from alumina dissolved in a fluoride-containing molten electrolyte having oxygen evolving metallic anodes facing a cell bottom with an aluminium-wettable drained cathode surface and an aluminium reservoir, and a method to produce aluminium in such an aluminium electrowinning cell.

BACKGROUND ART

The technology for the production of aluminium by the electrolysis of alumina, dissolved in molten cryolite containing salts, at temperatures around 950° C. is more than one hundred years old.

This process, conceived almost simultaneously by Hall and Héroult, has not evolved as much as other electrochemical processes, despite the tremendous growth in the total production of aluminium that in fifty years has increased almost one hundred fold. The process and the cell design have not undergone any great change or improvement and carbonaceous materials are still used as electrodes and cell linings.

The anodes are still made of carbonaceous material and must be replaced every few weeks. The operating temperature is still approximately 950° C. in order to have a sufficiently high rate of dissolution of alumina and a higher conductivity of the electrolyte.

The anodes have a very short life because during electrolysis the oxygen which should evolve on the anode surface combines with the carbon to form $CO_2$ and small amounts of CO. The actual consumption of the anode is approximately 450 kg/ton of aluminium produced which is more than ⅓ higher than the theoretical amount.

Another major drawback, however, is due to the fact that irregular electromagnetic forces create waves in the molten aluminium pool and the anode-cathode distance (ACD), also called interelectrode gap (IEG), must be kept at a safe minimum value of approximately 50 mm to avoid short circuiting between the aluminium cathode and the anode or reoxidation of the metal by contact with the $CO_2$ gas formed at the anode surface, leading to a lower current efficiency.

The high electrical resistivity of the electrolyte, which is about 0.4 ohm. cm., causes a voltage drop which alone represents more than 40% of the total voltage drop with a resulting high energy consumption which is close to 13 kWh/kgAl in the most modern cells. The cost of energy consumption has become an even bigger item in the total manufacturing cost of aluminium since the oil crisis, and has decreased the rate of production growth of this important metal.

While progress has been reported in the use of carbon cathodes to which have been applied coatings or layers of aluminium wettable materials which are also a barrier to sodium penetration during electrolysis, very little progress has been achieved in design of cathodes with a view to improving the overall cell efficiency, as well as restraining movement of the molten aluminium in order to reduce the interelectrode gap and the rate of wear of its surface.

U.S. Pat. No. 3,202,600 (Ransley) proposed the use of refractory borides and carbides as cathode materials, including a drained cathode cell design wherein a wedge-shaped consumable carbon anode was suspended facing a cathode made of plates of refractory boride or carbide in V-configuration.

U.S. Pat. Nos. 3,400,061 (Lewis/Altos/Hildebrandt) and 4,602,990 (Boxall/Gamson/Green/Stephen) disclose aluminium electrowinning cells with sloped drained cathodes arranged across the cell. In these cells, the molten aluminium flows down the sloping cathodes into a median longitudinal groove along the centre of the cell, or into lateral longitudinal grooves along the cell sides, for collecting the molten aluminium and delivering it to a sump located at one end of the cell.

By inclining the active surface of the cathode and of the anode the escape of the bubbles of the released gas is facilitated. Moreover, to have a cathode at a slope and obtain an efficient operation of the cell would be possible only if the surface of the cathode were aluminium-wettable so that the production of aluminium would take place on a film of aluminium.

Only recently has it become possible to coat carbon cathodes with a slurry which adheres to the carbon and becomes aluminium-wettable and very hard when the temperature reaches 700–800° C. or better 950–1000° C., as disclosed in U.S. Pat. No. 5,316,718 (Sekhar/de Nora) and U.S. Pat. No. 5,651,874 (de Nora/Sekhar). These patents proposed coating cell cathodes with a slurry-applied refractory boride, which proved excellent for cathode applications. These publications included a number of novel drained cathode configurations, for example including designs where a cathode body with an inclined upper drained cathode surface is placed on or secured to the cell bottom. Further design modifications in the cell construction could lead to obtaining more of the potential advantages of these coatings.

European Patent Application No. 0 393 816 (Stedman) describes another design for a drained cathode cell intended to improve the bubble evacuation. However, the manufacture of the electrodes with slopes as suggested is difficult. Additionally, such a drained cathode configuration cannot ensure optimal distribution of the dissolved alumina.

WO98/53120 (Berclaz/de Nora) discloses a cell provided with a cathode mass supported on a cathode shell or plate, the cathode mass being V-shaped and having along the bottom of the V-shape a central channel extending along the cell for draining molten aluminium.

U.S. Pat. No. 5,683,559 (de Nora) proposed a new cathode design for a drained cathode, where grooves or recesses were incorporated in the surface of blocks forming the cathode surface in order to channel the drained product aluminium. A specific embodiment provides an enhanced anode and drained cathode geometry where aluminium is produced between V-shaped anodes and cathodes and collected in recessed grooves. The V-shaped geometry of the anodes enables on the one hand a good bubble evacuation from underneath the anodes, and on the other hand it enables the drainage of produced aluminium from cathode surfaces into recessed grooves located at the bottom of the V-shapes.

OBJECTS OF THE INVENTION

It is an object of the invention to provide an aluminium electrowinning cell with oxygen-evolving anodes and having an aluminium-wettable drained cathode bottom and an aluminium collection reservoir from which molten aluminium is tapped.

A major object of the invention is to provide an aluminium electrowinning cell having an aluminium-wettable drained cathode which is made of conventional cell blocks which can be easily retrofitted in existing cells.

A further object of the invention is to provide an aluminium electrowinning cell having an aluminium collection reservoir from which molten aluminium can be tapped, without the risk to freeze and at a location where the reservoir can be easily retrofitted in existing cells.

Another object of the invention is to provide an aluminium-wettable cell bottom for such aluminium electrowinning cells.

Yet another object of the invention is to provide a method to produce aluminium in an aluminium electrowinning cell provided with such a cell bottom.

SUMMARY OF THE INVENTION

The invention provides a cell for the electrowinning of aluminium from alumina dissolved in a fluoride-containing molten electrolyte. The cell comprises a plurality of metal-based anodes provided with an oxygen evolving electrochemically active structure having a series of substantially vertical through-openings for the escape of anodically produced gaseous oxygen. The electrochemically active anode structure face and are spaced apart from an aluminium-wettable drained cathode surface on which aluminium is produced. The drained cathode surface is formed along the cell by upper surfaces of a series of juxtaposed carbon cathode blocks, the cathode blocks extending across the cell, for instance single blocks or pairs of blocks end-to-end extending across the entire width of drained cathode surface. The cathode blocks comprise means for connection to an external electric current supply.

According to the invention, the drained cathode surface is divided into quadrants, typically four quadrants, by a longitudinal aluminium collection groove along the cell and by at least one central aluminium collection reservoir across the cell. Pairs of quadrants across the cell are inclined in a V-shape relationship, the collection groove being located along the bottom of the V-shape and arranged to collect molten aluminium draining from the drained cathode surface and evacuate it into the aluminium collection reservoir(s) during cell operation.

As the collection reservoir is located centrally in the cell, the reservoir is protected from thermal losses.

The cell may comprise at least one carbon-based spacer block extending across the cell which is juxtaposed between cathode blocks extending across the cell. An upper surface of the spacer block comprises a central recess which is lower than the aluminium collection/evacuation groove and which extends substantially across the cell to form the abovementioned aluminium collection reservoir.

The central recess may extend between the juxtaposed cathode blocks to form with non-recessed end portions of the spacer block and juxtaposed sidewalls of the juxtaposed cathode blocks the aluminium collection reservoir. However, the reservoir may also be formed with the recess and exclusively with non-recessed side portions and end portions of the spacer block.

As an alternative to a single spacer block, a pair of spacer blocks arranged end-to-end may extend across the cell to space the abovementioned juxtaposed cathode blocks. Likewise, the drained cathode surface may also be formed along the cell by upper surfaces of a series of juxtaposed carbon cathode blocks extending in pairs arranged end-to-end across the cell.

The aluminium collection groove longitudinally dividing the drained cathode surface can be located below the bottom of the inclined quadrants.

The electrochemically active structure of the metal-based anodes may comprise a series of horizontal anode members, each having an electrochemically active surface on which during electrolysis oxygen is anodically evolved. The anode members may be in a parallel arrangement connected by at least one connecting cross-member or in a concentric arrangement connected by at least one generally radial connecting member.

For instance, the anode members of each anode may be in a generally coplanar arrangement and spaced laterally to form longitudinal flow-through openings for the up-flow of alumina-depleted electrolyte driven by the upward fast escape of anodically evolved oxygen, and for the down-flow of alumina-rich electrolyte. The anode members can be blades, bars, rods or wires as described in co-pending applications PCT/IB00/00029 and PCT/IB00/00027 (both in the name of de Nora).

Suitable materials for oxygen-evolving anodes include iron and nickel based alloys which may be heat-treated in an oxidising atmosphere as disclosed in WO00/06802, WO00/06803 (both in the name of Duruz/de Nora/Crottaz), WO00/06804 (Crottaz/Duruz), PCT/IB99/01976 (Duruz/de Nora) and PCT/IB99/01977 (de Nora/Duruz). Further oxygen-evolving anode materials are disclosed in WO99/36593, WO99/36594, WO00/06801, WO00/06805, PCT/IB00/00028 (all in the name of de Nora/Duruz), WO00/06800 (Duruz/de Nora), WO99/36591 and WO99/36592 (both in the name of de Nora).

The invention also relates to a cell bottom of a cell for the electrowinning of aluminium from alumina dissolved in a fluoride-containing molten electrolyte. The cell bottom comprises an aluminium-wettable drained cathode surface on which aluminium is produced. The drained cathode surface is formed along the cell bottom by upper surfaces of a series of juxtaposed carbon cathode blocks, the cathode blocks extending across the cell bottom and comprising means for connection to an external electric current supply.

The drained cathode surface is divided into four quadrants by a longitudinal aluminium collection groove along the cell bottom and by a central aluminium collection reservoir across the cell bottom. Pairs of quadrants across the cell bottom are inclined in a V-shape relationship, the collection groove being located along the bottom of the V-shape and arranged to collect molten aluminium draining from the drained cathode surface and evacuate it into the aluminium collection reservoir(s) during cell operation.

Another aspect of the invention is a method to produce aluminium in an aluminium electrowinning cell having anodes immersed in a molten electrolyte containing dissolved alumina which face a cell bottom as defined above. The method comprises electrolysing the molten electrolyte containing dissolved alumina between the anodes and the drained cathode surface to produce gas on the anodes and molten aluminium on the drained cathode surface; draining the cathodically produced molten aluminium from the drained cathode surface into the collection/evacuation groove; and evacuating the molten aluminium to the aluminium collection reservoir(s).

The method may include producing oxygen on a metal-based electrochemically active anode structure and releasing the produced oxygen through substantially vertical through-openings located in the anode structure.

The produced molten aluminium can be intermittently tapped from the aluminium collection reservoir.

The cell may be operated with a molten electrolyte at a temperature of 700° to 900 or 910° C., in particular between 730° and 870° C. or 750° and 850° C. However, the cell may also be operated at conventional temperatures, i.e. around 950° C.

DETAILED DESCRIPTION

Figure 1:
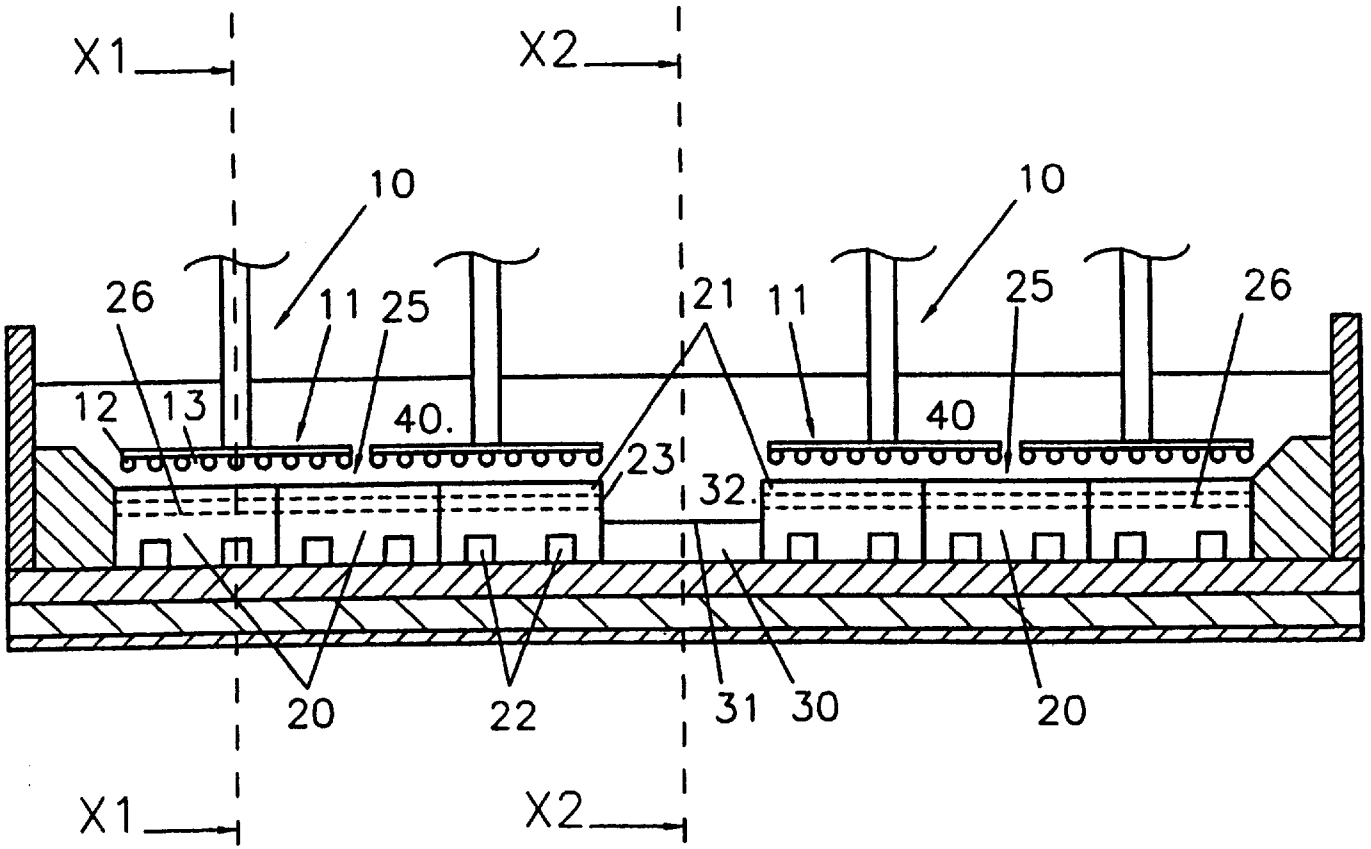
FIG. 1 schematically shows a longitudinal section of a cell according to the invention.
Figure 2:
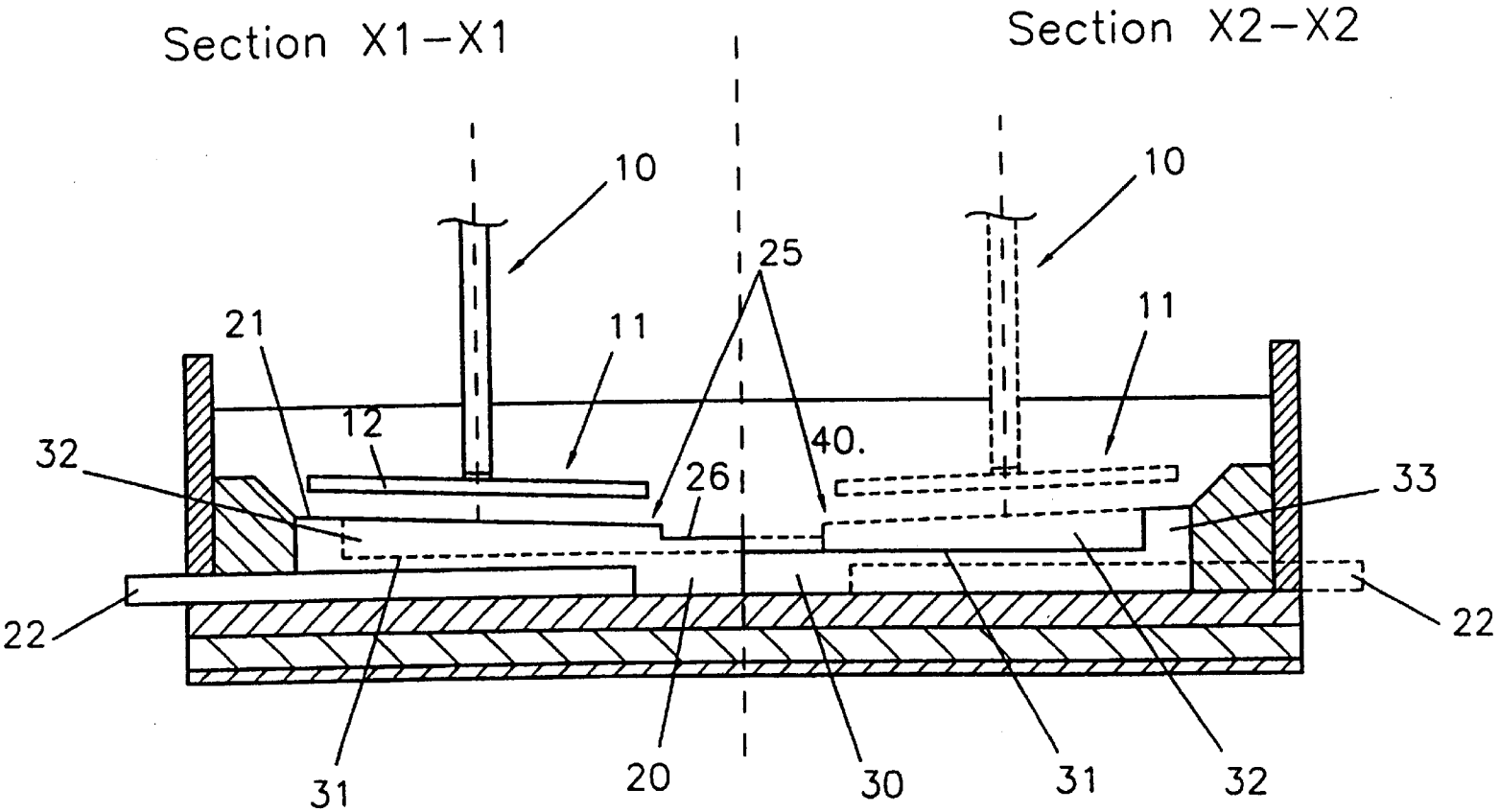
FIG. 2 schematically shows a cross-section of the cell shown in FIG. 1, the left-hand side showing a cross-section along the dotted line $X_1$—$X_1$ and the right hand side showing a cross-section along the dotted line $X_2$—$X_2$.
Figure 3:
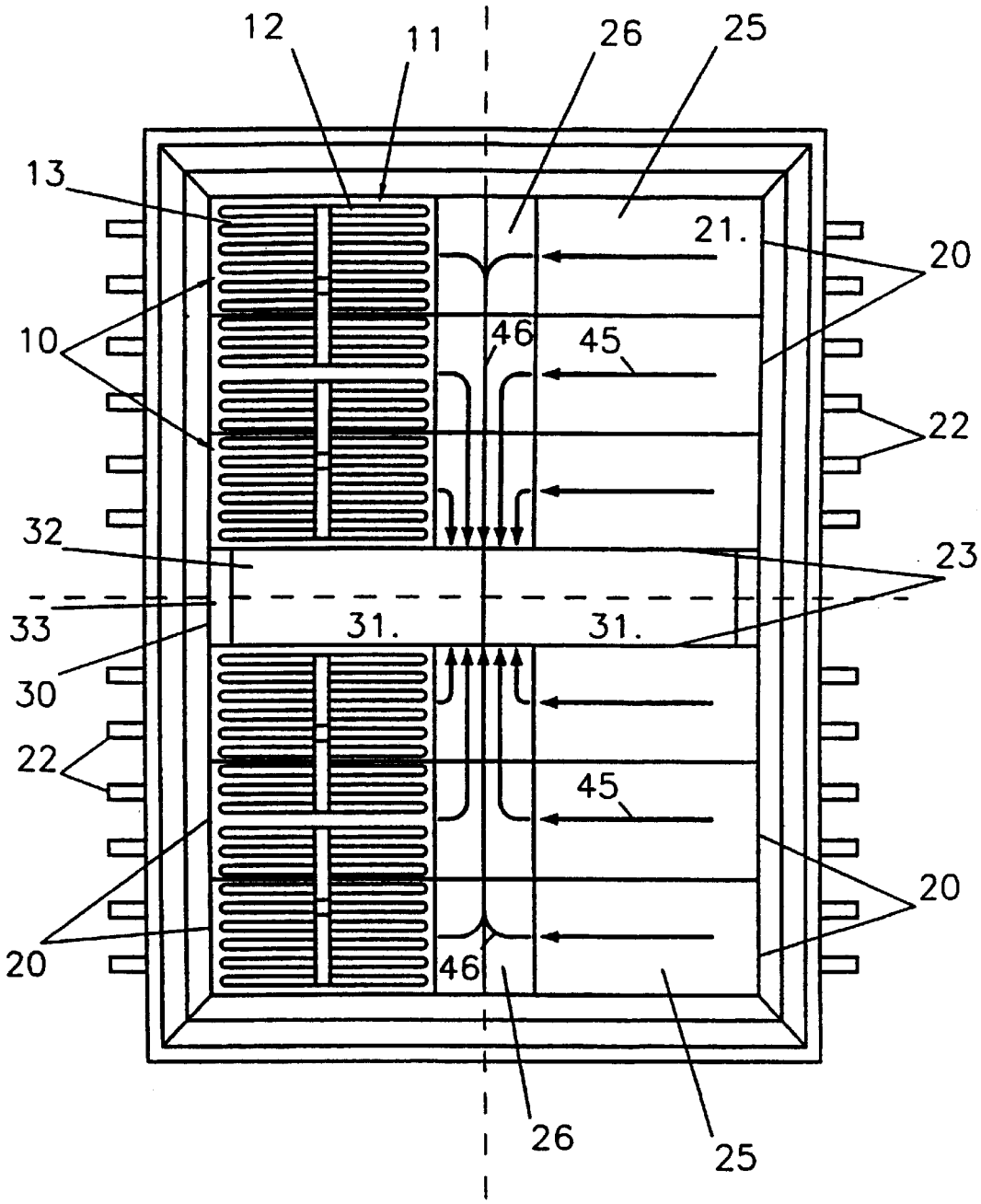
FIG. 3 is a schematic plan view of the bottom of the cell shown in FIG. 1, on the left-hand side the cell bottom is shown with facing anodes.

As stated above, FIGS. 1, 2 and 3 illustrate different views of a cell according to the invention.

The cell comprises a series of anodes 10 having oxygen-evolving active structures 11 provided with a series of vertical through openings 13 for the escape of anodically produced oxygen. Such anodes 10 may be designed as disclosed in co-pending applications PCT/IB00/00029 and PCT/IB00/00027 (both in the name of de Nora). As shown in FIGS. 1 and 3, each electrochemically active structure 11 comprises a series of parallel anode rods 12 in a generally coplanar arrangement and spaced laterally to form the flow-through openings 13 for the up-flow of alumina-depleted electrolyte driven by the upward fast escape of anodically evolved oxygen, and for the down-flow of alumina-rich electrolyte.

As shown in FIGS. 1 and 2, the anode structures 11 face and are spaced apart from an aluminium-wettable drained cathode surface 21.

The drained cathode surface 21 is formed by upper surfaces of a series of juxtaposed carbon cathode blocks 20 extending in pairs arranged end-to-end across the cell. Alternatively, the drained cathode surface may also be made of upper surfaces of a series of juxtaposed cathode blocks extending individually across the cell. The cathode blocks 20 comprise, embedded in recesses located in their bottom surfaces, current supply bars 22 of steel or other conductive material for connection to an external electric current supply.

The cathode blocks 20 are preferably coated with an aluminium-wettable coating providing the drained cathode surface 21, such as a coating of an aluminium-wettable refractory hard metal (RHM) having little or no solubility in aluminium and having good resistance to attack by molten cryolite. Useful RHM include borides of titanium, zirconium, tantalum, chromium, nickel, cobalt, iron, niobium and/or vanadium. Useful cathode materials are carbonaceous materials such as anthracite or graphite.

Preferred drained cathode coatings are slurry-applied coatings described in U.S. Pat. No. 5,651,874 (de Nora/Sekhar) and PCT/IB99/01982 (de Nora/Duruz). For instance U.S. Pat. No. 5,651,874 discloses a coating which consists of particulate refractory hard metal boride in a colloid applied from a slurry of the particulate refractory hard metal boride in a colloid carrier, wherein the colloid comprises at least one of colloidal alumina, silica, yttria, ceria, thoria, zirconia, magnesia, lithia, monoaluminium phosphate or cerium acetate. The colloidal carrier has been found to considerably improve the properties of the coating produced by non-reactive sintering.

Before or after application of the coating and before use, the upper surfaces of the components can be painted, sprayed, dipped or infiltrated with reagents and precursors, gels and/or colloids. For instance, before applying the slurry the components can be impregnated with e.g. a compound of lithium to improve the resistance to penetration by sodium, as described in U.S. Pat. No. 5,378,327 (Sekhar/Zheng/Duruz).

To assist rapid wetting of the drained cathode surface 21 by molten aluminium, the refractory coating may be exposed to molten aluminium in the presence of a flux assisting penetration of aluminium into the refractory material, the flux for example comprising a fluoride, a chloride or a borate, of at least one of lithium and sodium, or mixtures thereof. Such treatment favours aluminization of the refractory coating by the penetration therein of aluminium.

As shown in FIG. 3 and according to the invention, the drained cathode surface 21 is divided into four separate quadrants 25 by aluminium collection groove 26 along the cell and by a central aluminium collection reservoir 32 across the cell.

The aluminium collection reservoir 32 is formed by a central recess 31 in upper surfaces of a pair of spacer blocks 30 arranged end-to-end across the cell, the recess 31 being lower than the aluminium evacuation grooves 26. Alternatively, the central recess 31 may also be formed in an upper surface of a single spacer block 30 extending across the cell.

The spacer blocks 30 space apart and are juxtaposed between two pairs of cathode blocks 20, each pair being arranged end-to-end across the cell as described above.

The central recess 31 of the spacer blocks 30 extends between the juxtaposed cathode blocks 20 to form with non-recessed ends 33 of the spacer blocks 30, as shown on the right-hand side of FIG. 2, and with juxtaposed sidewalls 23 of the juxtaposed cathode blocks 20, as shown in FIG. 1, the aluminium collection reservoir 32.

As shown in FIG. 2, pairs of cathode blocks 20 across the cell are inclined in a V-shape relationship. Hence, the upper surface of each cathode block 20 can be machined in a single ramp along the block 20 to provide a V configuration by arrangement with a corresponding cathode block 20 end-to-end across the cell, as shown in FIG. 2.

The drained cathode surface 21 comprises along the bottom of the V-shape the collection groove 26. This groove 26 may be horizontal as shown in FIG. 1 or, alternatively, slightly sloping downwards towards the aluminium collection reservoir 32 to facilitate molten aluminium evacuation.

Similarly to the cathode blocks 20, the spacer blocks 30 can also be made by machining the upper surface of carbon blocks. However, in contrast to the cathode blocks 20, it is not necessary to connect the spacer blocks 30 to a negative current supply.

In operation of the cell illustrated in FIGS. 1 and 2, alumina dissolved in a molten electrolyte 40 at a temperature of 730° to 960° C. contained in the cell is electrolysed between the anodes 10 and the cathode blocks 20 to produce oxygen on the active structure 11 of the anodes 10 and molten aluminium on the aluminium-wettable drained cathode surface 21.

As shown in FIG. 3, the cathodically produced molten aluminium flows down the inclined drained cathode surface 21 of the quadrants 25 into the aluminium collection groove 26, as indicated by arrows 45. From the collection grooves 26, the produced molten aluminium flows into the central aluminium collection reservoir 32, as indicated by arrows 46, where it is collected and accumulated for intermittent tapping.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications and variations which fall within the spirit and broad scope of the appended claims.

For instance, the cell may have more than one aluminium collection reservoir across the cell, each intersecting the aluminium collection groove to divide the drained cathode surface into four quadrants. For example, a drained cathode surface may be divided into three pairs of quadrants across the cell by two spaced apart aluminium collection reservoirs across the cell intersecting the aluminium collection groove along the cell. Each aluminium collection reservoir co-operates with two pairs of quadrants across the cell (one pair on each side), the central pair of quadrants between the aluminium collection reservoirs being common to both reservoirs.

What is claimed is:

1. A cell for electrowinning aluminium from alumina dissolved in a fluoride-containing molten electrolyte, which cell has a length and a width, the length of the cell being greater than the width of the cell, and comprises a plurality of metal-based anodes provided with an oxygen evolving electrochemically active structure having a series of substantially vertical through-openings for escape of anodically produced gaseous oxygen, the electrochemically active structures facing and being spaced apart from an aluminium-wettable drained cathode surface on which aluminium is produced, the drained cathode surface being formed along the length of the cell by upper surfaces of a series of juxtaposed carbon cathode blocks, which cathode blocks have a length and a width, the length of the cathode blocks being greater than the width of the cathode blocks, and extend lengthwise across the width of the cell, the cathode blocks comprising a current supply bar extending along the length of the cathode blocks for connection to an external electric current supply, wherein the drained cathode surface is divided into quadrants by a longitudinal aluminium collection groove along the length of the cell and by at least one aluminium collection reservoir across the cell, the upper surface of the cathode blocks sloping down along the length of the cathode blocks towards the aluminium collection groove so that pairs of quadrants across the cell are inclined in a V-shape relationship, said aluminium collection groove being located along the bottom of the V-shape and arranged to collect molten aluminium draining from the drained cathode surface and evacuate the molten aluminium into the aluminium collection reservoir(s) during cell operation.

2. The cell of claim 1, comprising at least one carbon-based spacer block extending across the cell which spaces and is juxtaposed between cathode blocks extending across the cell, (an) upper surface(s) of the spacer block(s) comprising a recess which is lower than the aluminium collection groove and which extends substantially across the cell to form an aluminium collection reservoir.

3. The cell of claim 2, wherein said recess extends between said juxtaposed cathode blocks to form with juxtaposed sidewalls thereof an aluminium collection reservoir.

4. The cell of claim 2, wherein a pair of spacer blocks arranged end-to-end extends across the cell between said juxtaposed cathode blocks.

5. The cell of claim 1, wherein the drained cathode surface is formed along the cell by upper surfaces of a series of juxtaposed carbon cathode blocks extending in pairs arranged end-to-end across the cell.

6. The cell of claim 1, wherein the aluminium collection groove is located below the bottom of the inclined quadrants.

7. The cell of claim 1, wherein the electrochemically active structure of the metal-based anodes comprises a series of anode members, each having an electrochemically active surface on which during electrolysis oxygen is anodically evolved.

8. The cell of claim 7, wherein the anode members are in a parallel arrangement connected by at least one connecting cross-member.

9. The cell of claim 7, wherein the anode members are in a concentric arrangement connected by at least one generally radial connecting member.

10. The cell of claim 7, wherein the anode members are in a parallel or concentric arrangement connected by at least one connecting member, the electrochemically active surfaces of the anode members of each anode being in a generally coplanar arrangement and spaced laterally to form longitudinal flow-through openings for an up-flow of alumina-depleted electrolyte driven by the upward fast escape of anodically evolved oxygen, and for a down-flow of alumina-rich electrolyte.

11. The cell of claim 7, wherein the anode members of each anode are blades.

12. The cell of claim 7, wherein the anode members of each anode are bars, rods or wires.

13. The cell of claim 1, comprising a centrally located aluminium collection reservoir across the cell.

14. A cell bottom of a cell for electrowinning aluminium from alumina dissolved in a fluoride-containing molten electrolyte, which cell bottom has a length and a width, the length of the cell bottom being greater than the width of the cell bottom, and comprises an aluminium-wettable drained cathode surface on which aluminium is produced, the drained cathode surface being formed along the length of the cell bottom by upper surfaces of a series of juxtaposed carbon cathode blocks, which cathode blocks have a length and a width, the length of the cathode blocks being greater than the width of the cathode blocks, and extending lengthwise across the width of the cell bottom, the cathode blocks comprising a current supply bar extending along the length of the cathode blocks for connection to an external electric current supply, wherein the drained cathode surface is divided into quadrants by a longitudinal aluminium collection groove along the length of the cell bottom and by at least one aluminium collection reservoir across the cell bottom, the upper surface of the cathode blocks sloping down along the length of the cathode blocks towards the aluminium collection groove so that pairs of quadrants across the cell bottom are inclined in a V-shape relationship, said aluminium collection groove being located along the bottom of the V-shape and arranged to collect molten aluminium draining from the drained cathode surface and evacuate the molten aluminium into the aluminium collection reservoir(s) during cell operation.

15. The cell bottom of claim 14, comprising at least one carbon-based spacer block extending across the cell bottom which spaces and is juxtaposed between cathode blocks extending across the cell, (an) upper surface(s) of the spacer block(s) comprising a recess which is lower than the aluminium collection groove and which extends substantially across the cell to form an aluminium collection reservoir.

16. The cell bottom of claim 15, wherein said recess extends between said juxtaposed cathode blocks to form with juxtaposed sidewalls thereof an aluminium collection reservoir.

17. The cell bottom of claim 15, wherein a pair of spacer blocks arranged end-to-end extends across the cell bottom to space said juxtaposed cathode blocks.

18. The cell bottom of claim 14, wherein the drained cathode surface is formed along the cell bottom by upper surfaces of a series of juxtaposed carbon cathode blocks extending in pairs arranged end-to-end across the cell bottom.

19. The cell bottom of claim 14, wherein the aluminium collection groove is located below the bottom of the inclined quadrants.

20. The cell bottom of claim 14, comprising a centrally located aluminium collection reservoir across the cell.

21. A method to produce aluminium in an aluminium electrowinning cell having anodes immersed in a molten electrolyte containing dissolved alumina and which face a cell bottom as defined in claim 14 comprising an aluminium-wettable drained cathode surface which is formed by upper surfaces of a series of cathode blocks and which is divided into quadrants by a longitudinal aluminium collection groove along the cell and by at least one aluminium collection reservoir across the cell, pairs of quadrants across the cell being inclined in a V shape relationship, the collection groove being located along the bottom of the V-shape, the method comprising electrolysing the electrolyte containing dissolved alumina between the anodes and the drained cathode surface to produce gas on the anodes and molten aluminium on the drained cathode surface; draining the cathodically produced molten aluminium from the drained cathode surface into the collection groove; and evacuating the molten aluminium to the aluminium collection reservoir (s).

22. The method of claim 21, comprising producing oxygen on a metal-based electrochemically active anode structure and releasing the produced oxygen through substantially vertical through-openings located in the anode structure.

23. The method of claim 21, comprising intermittently tapping the produced aluminium from the aluminium collection reservoir.

24. The method of claim 21, wherein the cell is operated with a molten electrolyte at a temperature of 700° to 910° C.

25. The method of claim 24, wherein the cell is operated with a molten electrolyte at a temperature of 730° to 870° C.

26. The method of claim 21, wherein the cell comprises thereacross a centrally located aluminium collection reservoir to which molten aluminium is evacuated.

* * * * *